US009751323B2

(12) United States Patent
Miravet Jimenez et al.

(10) Patent No.: US 9,751,323 B2
(45) Date of Patent: Sep. 5, 2017

(54) THERMALLY-INDUCED RECIRCULATION OF PRINTING FLUID

(71) Applicant: HEWLETT-PACKARD DEVELOPMENT COMPANY, L.P., Houston, TX (US)

(72) Inventors: Joan-Albert Miravet Jimenez, Sant Cugat del Valles (ES); Alex Andrea Tallada, Barcelona (ES); Francisco Lopez Moral, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/913,534

(22) PCT Filed: Aug. 27, 2013

(86) PCT No.: PCT/US2013/056886

§ 371 (c)(1),
(2) Date: Feb. 22, 2016

(87) PCT Pub. No.: WO2015/030735

PCT Pub. Date: Mar. 5, 2015

(65) Prior Publication Data

US 2016/0207325 A1 Jul. 21, 2016

(51) Int. Cl.
*B41J 2/18* (2006.01)
*B41J 2/175* (2006.01)

(52) U.S. Cl.
CPC ..... *B41J 2/18* (2013.01); *B41J 2/17593* (2013.01)

(58) Field of Classification Search
None
See application file for complete search history.

(56) References Cited

U.S. PATENT DOCUMENTS

| | | | | |
|---|---|---|---|---|
| 5,818,485 | A | 10/1998 | Rezanka | |
| 6,007,193 | A | 12/1999 | Kashimura et al. | |
| 6,074,035 | A | 6/2000 | Irizawa et al. | |
| 8,360,560 | B2 | 1/2013 | Omer et al. | |
| 8,419,150 | B2 | 4/2013 | Bansyo | |
| 2013/0063504 | A1 | 3/2013 | Shimizu et al. | |
| 2013/0076811 | A1* | 3/2013 | Honda | B41J 2/17509 347/6 |

FOREIGN PATENT DOCUMENTS

| | | |
|---|---|---|
| CN | 102673164 | 9/2012 |
| EP | 0931662 | 7/1999 |

OTHER PUBLICATIONS

International Search Report. dated May 7, 2014. Application No. PCT/US2013/056886, Filing date Aug. 27, 2013.

* cited by examiner

*Primary Examiner* — Lisa M Solomon
(74) *Attorney, Agent, or Firm* — HP Inc.—Patent Department

(57) ABSTRACT

A printing fluid delivery system includes a reservoir, a conduit system, and a first heating module. The reservoir may store printing fluid. The conduit system may include a plurality of conduit segments to transport the printing fluid between the reservoir and the printing fluid applicator. The first heating module may selectively heat one conduit segment to increase a temperature of the printing fluid therein to a first temperature which is greater than a second temperature of the printing fluid in an other conduit segment, and to thermally induce recirculation of the printing fluid.

19 Claims, 6 Drawing Sheets

THERMALLY-INDUCED RECIRCULATION OF PRINTING FLUID

BACKGROUND

Printing systems may include a printing fluid delivery system and a printing fluid applicator. The printing fluid delivery system may supply printing fluid to the printing fluid applicator. The printing fluid applicator may apply the printing fluid therein to form images on a substrate.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems may include a printing fluid delivery system and a printing fluid applicator. The printing fluid delivery system may supply printing fluid to the printing fluid applicator. The printing fluid applicator may apply the printing fluid therein to form images on a substrate. Printing fluid such as ultraviolet curing ink, however, may need to possess acceptable property such as an appropriate viscosity to be successfully applied by the printing fluid applicator to the substrate. Such acceptable properties may be achieved, for example, by placing the pooling fluid within a target temperature range. However, a respective temperature of the printing fluid may decrease below the target temperature range when it is not flowing and change the printing fluid properties to unacceptable levels. Consequently, the printing fluid may not be satisfactorily applied to the substrate.

In examples, a printing fluid delivery system includes a conduit system including a plurality of conduit segments to transport the printing fluid between the reservoir and the printing fluid applicator. The printing fluid delivery system also includes a first heating module to selectively heat one conduit segment. The one conduit segment, upon being heated, increases a temperature of the printing fluid therein to a first temperature which is greater than a second temperature of the printing fluid in an other conduit segment. Consequently, the one conduit segment thermally induces recirculation of the printing fluid from the printing fluid applicator through at least the one conduit segment and back to the printing fluid applicator. Thus, the printing fluid in the printing fluid applicator may be thermally-induced to recirculate to maintain it at target temperature. Consequently, with the printing fluid at a temperature within the target temperature range, the printing fluid may possess acceptable properties to be satisfactorily applied by the printing fluid applicator to a substrate.

Figure 1:
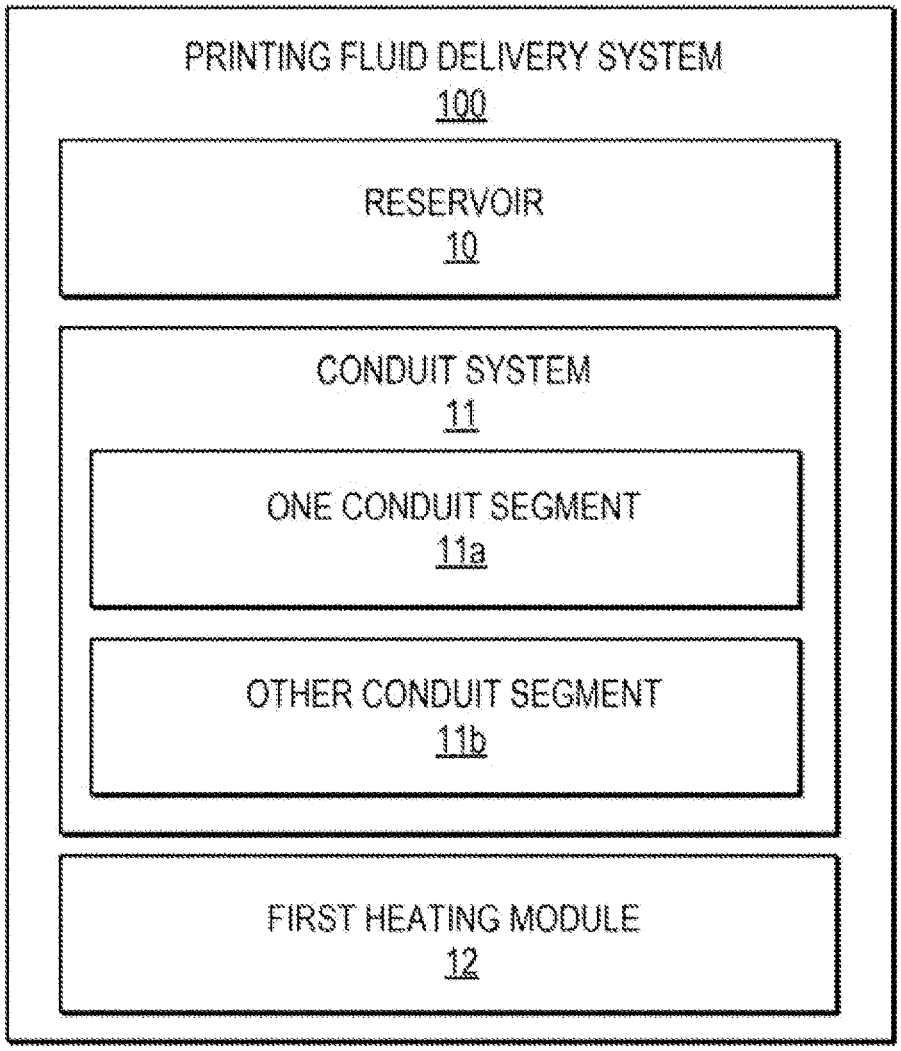
FIG. 1 is a block diagram illustrating a printing fluid delivery system according to an example.

FIG. 1 is a block diagram illustrating a printing fluid delivery system according to an example. The printing fluid delivery system 100 may be usable with a printing fluid applicator. Referring to FIG. 1, in some examples, the printing fluid delivery system 100 may include a reservoir 10, a conduit system 11, and a first heating module 12. The reservoir 10 may store printing fluid, for example, to be supplied to and used by the printing fluid applicator. That is, the printing fluid applicator may selectively apply printing fluid onto a substrate. In some examples, the printing fluid applicator may include a printhead, a plurality of printhead modules, a print bar, and/or a printed assembly, and the like. For example, the printing fluid applicator may include an inkjet printhead to eject printing fluid such as ultraviolet curing ink to form images on the substrate.

Referring to FIG. 1, in some examples, the conduit system 11 may include a plurality of conduit segments 11*a* and 11*b* to transport the printing fluid between the reservoir 10 and the printing fluid applicator. The first heating module 12 may selectively heat one conduit segment 11*a*. In some examples, the one conduit segment 11*a* may be formed of metal. The first heating module 12 may apply a heat flux to the one conduit segment 11*a* to heat the printing fluid therein. When heated, the one conduit segment 11*a* may increase a temperature of the printing fluid therein to a first temperature which is greater than a second temperature of the printing fluid in an other conduit segment life. In some examples, the first temperature may be about fifty degrees Celsius. Consequently, the one conduit segment 11*a* may thermally induce recirculation of the printing fluid from the printing fluid applicator through at least the one conduit segment 11*a* and back to the printing fluid applicator.

Figure 2A:
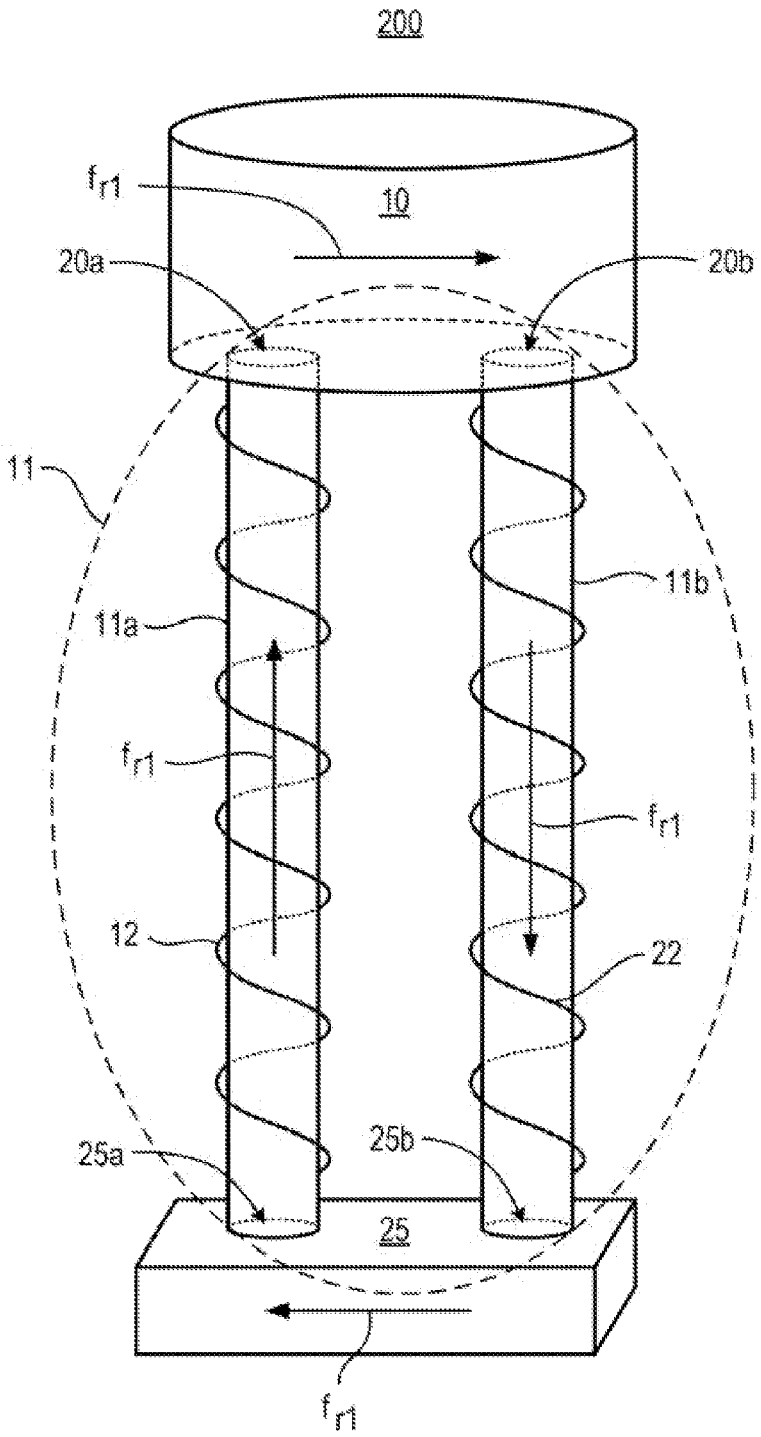
FIGS. 2A and 2B are schematic views illustrating a printing fluid delivery system according to examples.
Figure 2B:
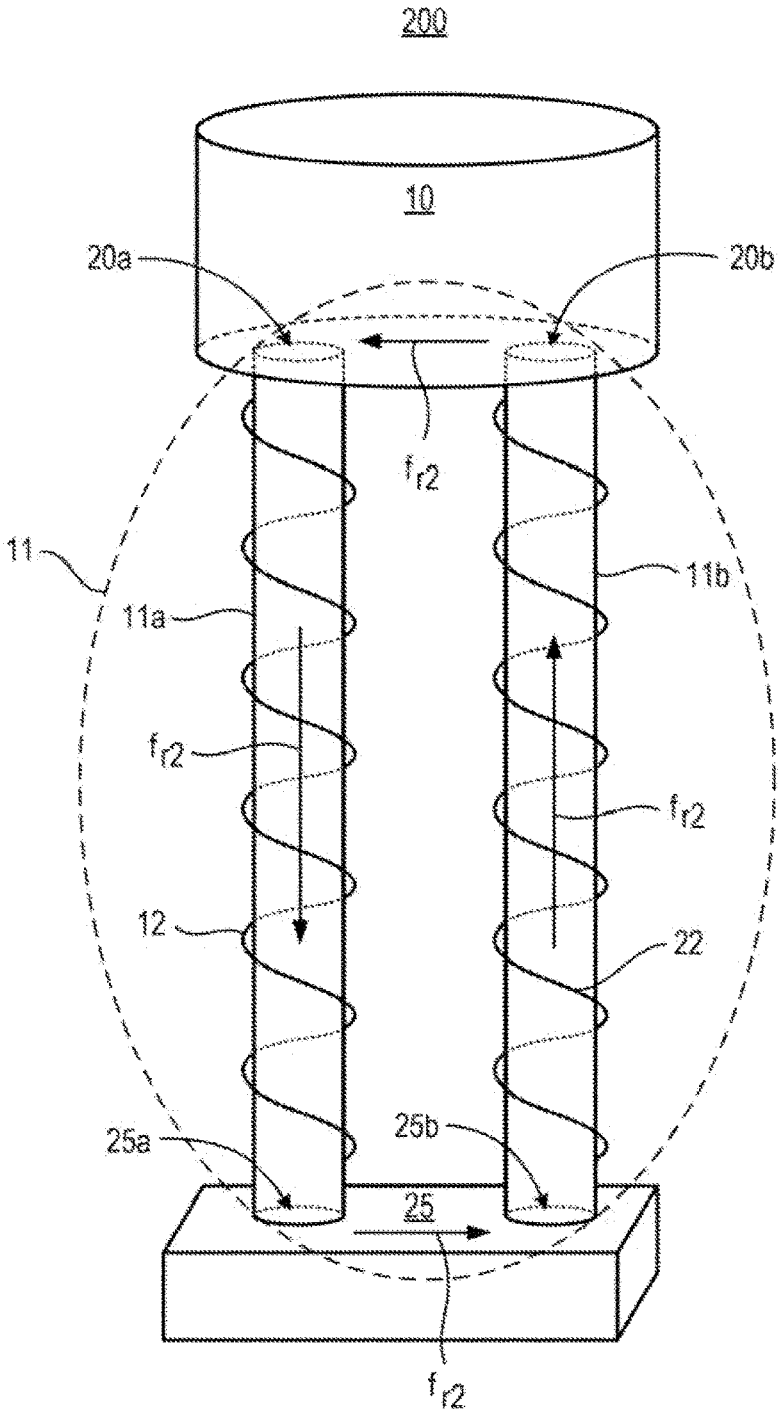

FIGS. 2A and 2B are schematic views illustrating a printing fluid delivery system according to examples. The printing fluid delivery system 200 may be usable with a printing fluid applicator 25. Referring to FIGS. 2A and 2B, in some examples, the printing fluid delivery system 200 may include the reservoir 10, the conduit system 11, and the first heating module 12 as previously discussed with respect to the printing fluid delivery system 100 of FIG. 1. Referring to FIGS. 2A and 2B, the printing fluid delivery system 200 may also include a second heating module 22. In some examples, the one conduit segment 11*a* may be coupled to a first opening 20*a* of the reservoir 10 and a first opening 25*a* of the printing fluid applicator 25. The other conduit segment 11*b* may be coupled to a second opening 20*b* of the reservoir 10 and a second opening 25*b* of the printing fluid applicator 25.

Referring to FIG. 2A, in some examples, the first heating module 12 may selectively heat the printing fluid in the one conduit segment 11*a* to the first temperature to maintain the printing fluid in the printing fluid applicator 25 within a target temperature range. In some examples, the first heating module 12 may include a first heater and a first fluid parameter sensor (not illustrated) in contact with printing fluid to sense at least one of temperature and pressure of the printing fluid. Such information may be used to actuate and deactivate the first heater, and the like. In some examples, the target temperature range is forty-nine to fifty-one degrees Celsius. The first temperature of the printing fluid in the one conduit segment 11*a* may be greater than the second temperature of the printing fluid in the other conduit segment 11*b* to thermally induce recirculation. The thermally-induced recirculation may result in recirculation of the printing fluid from the printing fluid applicator 25 through the one conduit segment 11*a*, through the reservoir 10, through the other conduit segment 11*b*, and back to the printing fluid applicator 25. For example, a fluid flow direction $f_{r1}$ of the thermally-induced printing fluid in the other conduit segment 11*b* may be from the reservoir 10 toward the printing fluid applicator 25. Additionally, the fluid flow direction $f_{r1}$ of the thermally-induced printing fluid in the one conduit segment 11*a* may be from the printing fluid applicator 25 to the reservoir 10.

Referring to FIG. 2B, in some examples, the second heating module 22 may selectively heat the other conduit segment 11*b* such that a temperature of the printing fluid therein is increased to a third temperature which is greater than the first temperature of the printing fluid in the one conduit segment 11*a* to thermally induce recirculation. In some examples, the second heating module 22 may include a second heater and a second fluid parameter sensor (not illustrated) in contact with printing fluid to sense at least one of temperature and pressure of the printing fluid. Such information may be used to activate and deactivate second heater, and the like. For example, the thermally induced recirculation (e.g., fluid flow $f_{r2}$) may result in recirculation of the printing fluid from the printing fluid applicator 25 through the other conduit segment 11*b*, through the reservoir 10, through the one conduit segment 11*a*, and back to the printing fluid applicator 25. For example, a fluid flow direction $fr_2$ of the thermally-induced printing fluid in the other conduit segment 11*b* may be from the printing fluid applicator 25 toward the reservoir 10. Additionally the fluid flow direction $fr_2$ of the thermally-induced printing fluid in the one conduit segment 11*a* may be from the reservoir 10 toward the printing fluid applicator 25.

Figure 3:
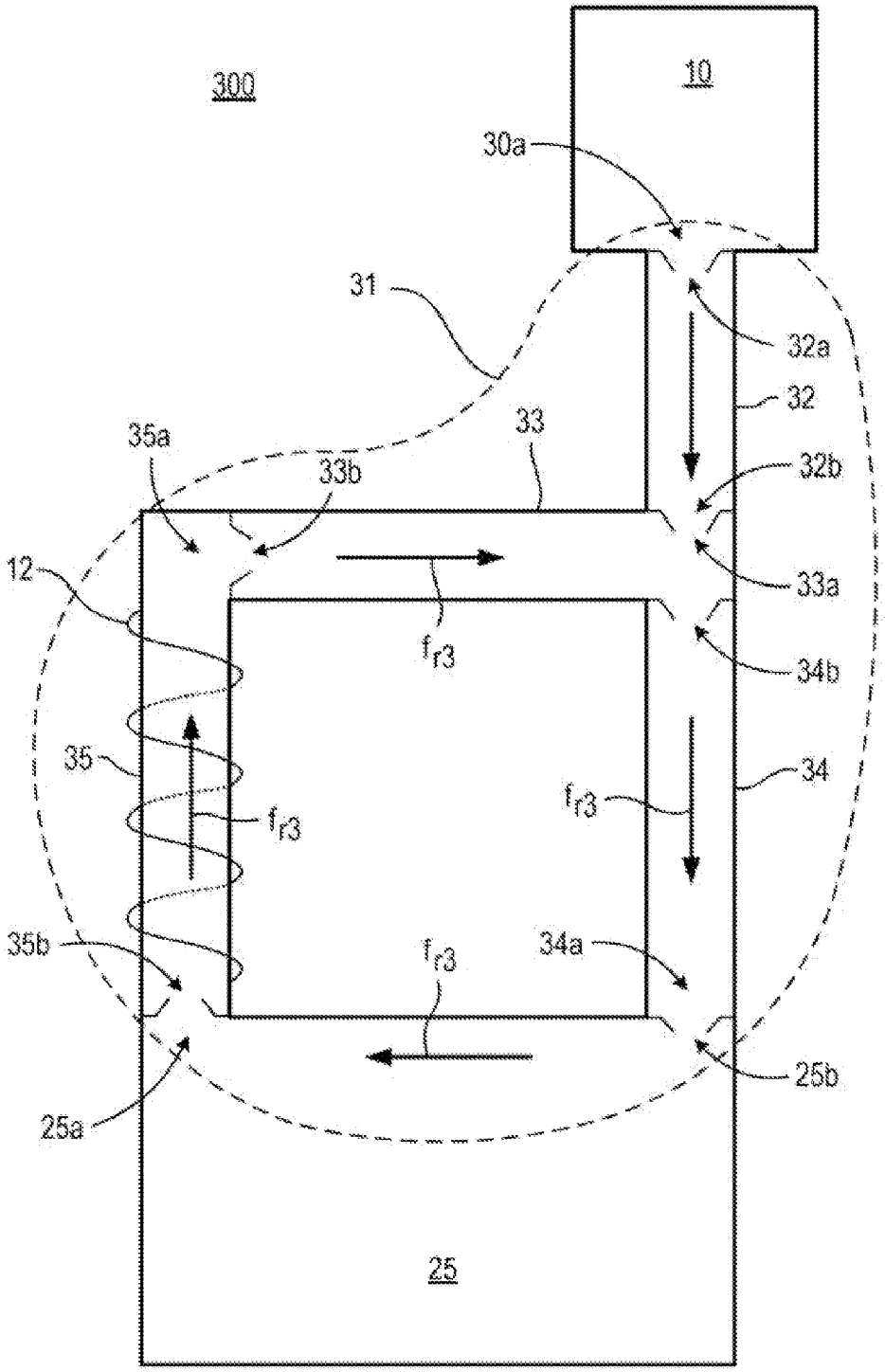
FIG. 3 is a schematic view illustrating a printing fluid delivery system according to an example.

FIG. 3 is a schematic view illustrating a printing fluid delivery system according to an example. The printing fluid delivery system 300 may be usable with a printing fluid applicator 25. Referring to FIG. 3, in some examples, the printing fluid delivery system 300 may include the reservoir 10 and the first heating module 12 as previously discussed with respect to the printing fluid delivery system 100 and 200 of FIGS. 1, 2A and 2B. Referring to FIG. 3, in some examples, the printing fluid delivery system 300 may also include a conduit system 31 including a plurality of conduit segments 32, 33, 34 and 35. The plurality of conduit segments 32, 33, 34 and 35 may include a first conduit segment 32, a second conduit segment 33, a third conduit segment 34, and a heated conduit segment 35.

Referring to FIG. 3, in some examples, the first conduit segment 31 may have a first input end 32*a* coupled to a single opening 30*a* of the reservoir 20 and a first output end 32*b*. The second conduit segment 33 may have a second output end 33*a* coupled to the first output end 32*b* and a second input end 33*b*. The heated conduit segment 35 may have a heated output end 35*a* coupled to the second input end 33*b* and a heated input end 35*b* coupled to the first opening 25*a* of the printing fluid applicator 25. The third conduit segment 34 may have a third output end 34*a* coupled to the second opening 26*b* of the printing fluid applicator 25 and a third input end 34*b* coupled to the second output end 33*b*. The third input end 34*b* may also be coupled to the first output end 32*b*.

Referring to FIG. 3, in some examples, the heated conduit segment 35 may be heated by the first heating module 12. As a result, the printing fluid in the first heated conduit segment 35 may be heated to a temperature greater than a temperature of the printing fluid in the first, second, and third conduit segments 32, 33, and 34. Consequently, recirculation of the printing fluid from the printing fluid applicator 25, through the heated conduit segment 35, through the second conduit segment 33, through the third conduit segment 34, and back to the printing fluid applicator 25 may be thermally-induced. That is, thermally-induced recirculation may cause fluid flow $f_{r3}$ from the printing fluid applicator 25, through the heated conduit segment 35, through the second conduit segment 33, through the third conduit segment 34, and back to the printing fluid applicator 25. In some examples, the first heating module 12 may include a first heater and a first fluid parameter sensor (not illustrated) in contact with printing fluid to sense at least one of temperature and pressure of the printing fluid. Such information may be used to activate and deactivate the first heater, and the like. In some examples, the printing fluid may include an ultraviolet curing ink. Additionally, in some examples, the printing fluid applicator 25 may include an inkjet printhead to eject the ultraviolet curing ink onto a substrate.

Figure 4:
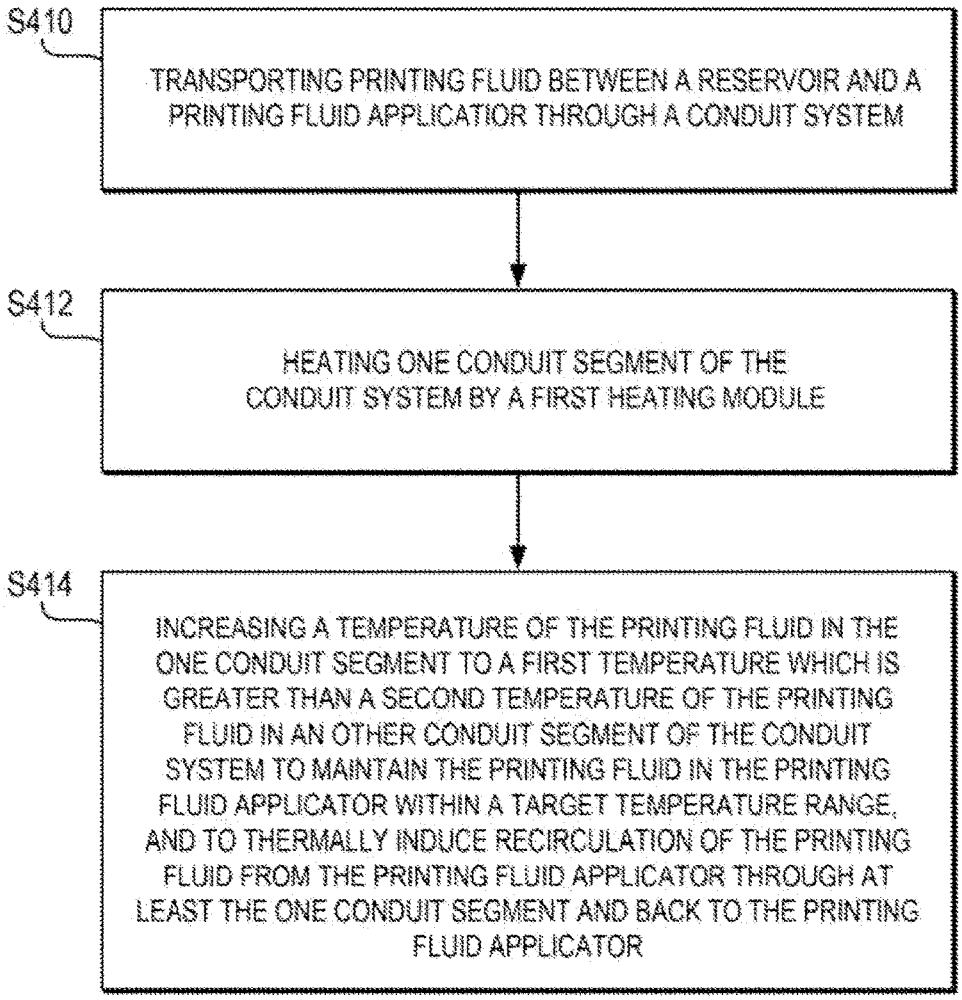
FIG. 4 is a flowchart illustrating a method of recirculating printing fluid to a printing fluid applicator according to an example.

FIG. 4 is a flowchart illustrating a method of recirculating printing fluid to a printing fluid applicator according to an example. In block S410, printing fluid is transported between a reservoir and a printing fluid applicator through a conduit system. In some examples, the printing fluid includes an ultraviolet curing ink and the printing fluid applicator includes an inkjet printhead to eject the ultraviolet curing ink onto a substrate. In block S412, one conduit segment of the conduit system is heated by a first heating module. For example, heating the one conduit segment of the conduit system by the first heating module may occur when the printing fluid applicator is not applying the printing fluid in the printing fluid applicator to a substrate and/or when the printing fluid in the printing fluid applicator is outside the target temperature range. In some examples, the target temperature range is forty-nine to fifty-one degrees Celsius. Additionally, in some examples, the one conduit segment may be formed of metal.

In block S414, a temperature of the printing fluid in the one conduit segment is increased to a first temperature which is greater than a second temperature of the printing fluid in an other conduit segment of the conduit system to maintain the printing fluid in the printing fluid applicator within a target temperature range and to thermally induce recirculation. The thermally-induced recirculation may recirculate the printing fluid from the printing fluid applicator through at least the one conduit segment and back to the printing fluid applicator. Additionally, the first temperature to which the printing fluid in the one conduit segment may be increased is greater than the second temperature of the printing fluid in the other conduit segment to maintain the printing fluid in the printing fluid applicator within a target temperature range. In some examples, the first temperature may be about fifty degrees Celsius. In some examples, the one conduit segment is coupled to a first opening of the reservoir and a first opening of the printing fluid applicator. Additionally, in some examples, the other conduit segment is coupled to a second opening of the reservoir and a second opening of the printing fluid applicator.

Figure 5:
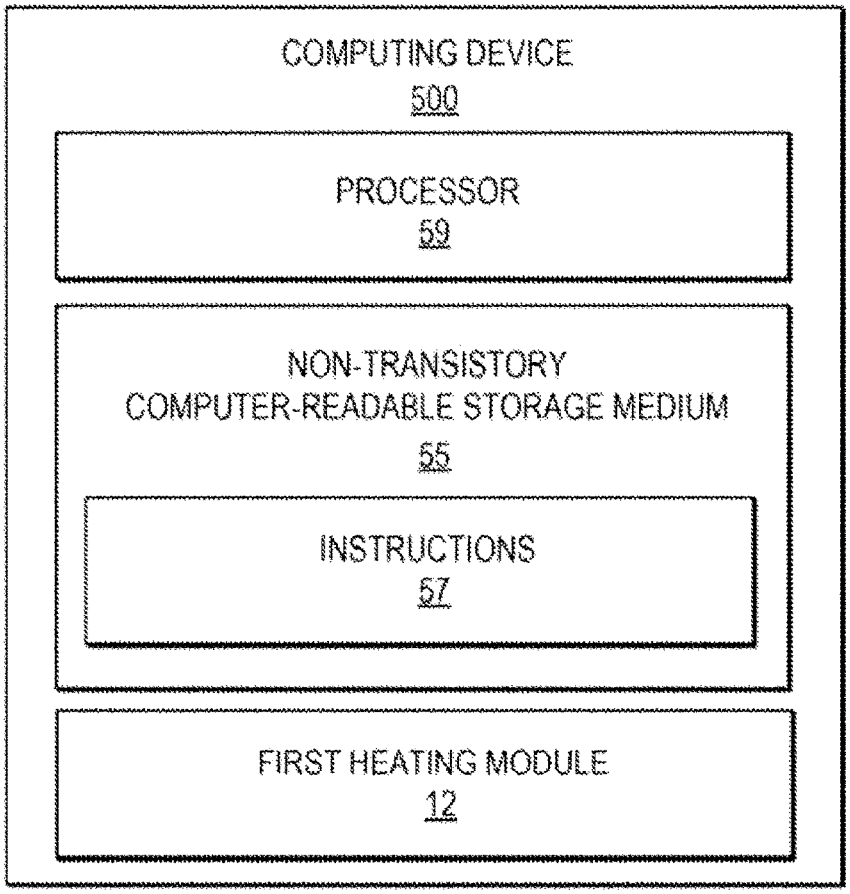
FIG. 5 is a block diagram illustrating a computing device including a processor and a non-transitory, computer-readable storage medium to store instructions to recirculate printing fluid to a printing fluid applicator according to an example.

FIG. 5 is a block diagram illustrating a computing device including a processor and a non-transitory, computer-readable storage medium to store instructions to recirculate printing fluid to a printing fluid applicator according to an example. Referring to FIG. 5, in some examples, the non-transitory, computer-readable storage medium 55 may be included in a computing device 500 such as a printing system. In some examples, the non-transitory, computer-readable storage medium 55 may be implemented in whole or in part as instructions 57 such as computer-implemented instructions stored in the computing device locally or remotely, for example, in a server or a host computing device.

Referring to FIG. 5, in some examples, the non-transitory, computer-readable storage medium 55 may correspond to a storage device that stores instructions 57, such as computer-implemented instructions and/or programming code, and the like. For example, the non-transitory, computer-readable storage medium 55 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 5, examples of storage devices include, but are not limited to, hard disk drives, compact disc drives, digital versatile disc drives, optical drives, and flash memory devices. In some examples, the non-transitory, computer-readable storage medium 55 may even be paper or another suitable medium upon which the instructions 57 are printed, as the instructions 57 can be electronically captured, via, for instance, optical scanning of the paper or other medium, then compiled, interpreted or otherwise processed in a single manner, if necessary, and then stored therein. A processor 59 generally retrieves and executes the instructions 57 stored in the non-transitory, computer-readable storage medium 55, for example, to operate a computing device 500 such as a printing system including a first heating module 12 to recirculate printing fluid to a printing fluid applicator in accordance with an example. In some examples, the first heating module 12 may include a first heater and a first fluid parameter sensor (not illustrated) in contact with printing fluid to sense at least one of temperature and pressure of the printing fluid. Such information may be used to activate and deactivate the first heater, and the like. In an example, the non-transitory, computer-readable storage medium 55 can be accessed by the processor 59.

It is to be understood that the flowchart of FIG. 4 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 4 illustrates a specific order of execution, the order of execution may differ from that which is depicted. For example, the order of execution of two or more blocks may be rearranged relative to the order illustrated. Also, two or more blocks illustrated in succession in FIG. 4 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of recirculating printing fluid to a printing fluid applicator, the method comprising:

transporting printing fluid between a reservoir and a printing fluid applicator through a conduit system;

heating one conduit segment of the conduit system by a first heating module; and increasing a temperature of the printing fluid in the one conduit segment to a first temperature which is greater than a second temperature of the printing fluid in an other conduit segment of the conduit system to maintain the printing fluid in the printing fluid applicator within a target temperature range, and to thermally induce recirculation of the printing fluid from the printing fluid applicator through at least the one conduit segment and back to the printing fluid applicator.

2. The method of claim 1, wherein the one conduit segment is coupled to a first opening of the reservoir and a first opening of the printing fluid applicator, and the other conduit segment is coupled to a second opening of the reservoir and a second opening of the printing fluid applicator.

3. The method of claim 1, wherein the heating the one conduit segment of the conduit system by the first heating module further comprises: heating the one conduit segment of the conduit system by the first heating module when the printing fluid applicator is not applying the printing fluid in the printing fluid applicator to a substrate.

4. The method of claim 3, wherein the heating the one conduit segment of the conduit system by the first heating module further comprises:

heating the one conduit segment of the conduit system by the first heating module when the printing fluid in the printing fluid applicator is outside the target temperature range.

5. The method of claim 4, wherein the printing fluid is an ultraviolet curing ink and the target temperature range is forty-nine to fifty-one degrees Celsius.

6. A printing fluid delivery system usable with a printing fluid applicator, the printing fluid delivery system comprising: a reservoir to store printing fluid; a conduit system including a plurality of conduit segments to transport the printing fluid between the reservoir and the printing fluid applicator; and a first heating module to selectively heat one conduit segment of the plurality of conduit segments, the one conduit segment to increase a temperature of the printing fluid therein to a first temperature which is greater than a second temperature of the printing fluid hi an other conduit segment of the plurality of conduit segments, and to thermally induce recirculation of the printing fluid from the printing fluid applicator through at least the one conduit segment and back to the printing fluid applicator.

7. The printing fluid delivery system of claim 6, wherein the first heating module is configured to selectively heat the printing fluid in the one conduit segment to the first temperature to maintain the printing fluid in the printing fluid applicator within a target temperature range.

8. The printing fluid delivery system of claim 6, wherein the one conduit segment is coupled to a first opening of the reservoir and a first opening of the printing fluid applicator, and the other conduit segment is coupled to a second opening of the reservoir and a second opening of the printing fluid applicator.

9. The printing fluid delivery system of claim 8, wherein the thermally-induced recirculation results in recirculation of the printing fluid from the printing fluid applicator through the other conduit segment, through the reservoir, through the one conduit segment, and back to the printing fluid applicator.

10. The printing fluid delivery system of claim 8, further comprising:

a second heating module to selectively heat the other conduit segment, the other conduit segment to increase a temperature of the printing fluid therein to a third temperature which is greater than the first temperature of the printing fluid in the one conduit segment, and to thermally induce recirculation of the printing fluid from the printing fluid applicator through the one conduit segment, through the reservoir, through the other conduit segment, and back to the printing fluid applicator.

11. The printing fluid delivery system of claim 6, wherein the plurality of conduit segments comprises:

a first conduit segment having a first input end coupled to a single opening of the reservoir and a first output end;

a second conduit segment having a second output end coupled to the first output end and a second input end;

a heated conduit segment having a heated output end coupled to the second input end and a heated input end coupled to the first opening of the printing fluid applicator; and a third conduit segment having a third output end coupled to the second opening of the printing fluid applicator and a third input end coupled to the second output end.

12. The printing fluid delivery system of claim 6, wherein the one conduit segment is formed of metal.

13. The printing fluid delivery system of claim 6, wherein the printing fluid comprises an ultraviolet curing ink and the printing fluid applicator includes an inkjet printhead to eject the ultraviolet curing ink onto a substrate.

14. A non-transitory computer-readable storage medium having computer executable instructions stored thereon to operate a printing fluid delivery system to recirculate printing fluid to a printing fluid applicator, the instructions are executable by a processor to:

transport printing fluid between a reservoir and a printing fluid applicator through a conduit system;

heat a first conduit segment of the conduit system by a first heating module; and increase a temperature of the printing fluid in the first conduit segment to a first temperature which is greater than a second temperature of the printing fluid in a second conduit segment of the conduit system to thermally induce recirculation of the printing fluid from the printing fluid applicator through the conduit system and back to the printing fluid applicator, and to maintain the printing fluid in the printing fluid applicator within a target temperature range.

15. The medium of claim 14, wherein the instructions are executable by a processor to cause the first heating module to selectively heat the printing fluid in the first conduit segment to the first temperature to maintain the printing fluid in the printing fluid applicator within the target temperature range.

16. The medium of claim 14, wherein the first conduit segment is coupled to a first opening of the reservoir and a first opening of the printing fluid applicator, and the second conduit segment is coupled to a second opening of the reservoir and a second opening of the printing fluid applicator.

17. The medium of claim 16, wherein the instructions are executable by a processor to cause recirculation of the printing fluid from the printing fluid applicator through the second conduit segment, through the reservoir, through the first conduit segment, and back to the printing fluid applicator.

18. The medium of claim 16, wherein the instructions are executable by a processor to:

cause a second heating module to selectively heat the second conduit segment, the second conduit segment to increase a temperature of the printing fluid therein to a third temperature which is greater than the first temperature of the printing fluid in the first conduit segment, and to thermally induce recirculation of the printing fluid from the printing fluid applicator through the first conduit segment, through the reservoir, through the second conduit segment, and back to the printing fluid applicator.

19. The medium of claim 14, wherein the conduit system includes a plurality of conduit segments to transport the printing fluid between the reservoir and the printing fluid applicator, the plurality of conduit segments comprising:

the first conduit segment having a first input end coupled to a single opening of the reservoir and a first output end;

the second conduit segment having a second output end coupled to the first output end and a second input end;

a heated conduit segment having a heated output end coupled to the second input end and a heated input end coupled to the first opening of the printing fluid applicator; and a third conduit segment having a third output end coupled to the second opening of the printing fluid applicator and a third input end coupled to the second output end.

* * * * *